US010494796B2

(12) United States Patent
Varma

(10) Patent No.: US 10,494,796 B2
(45) Date of Patent: Dec. 3, 2019

(54) TUB SPOUT ENGINE

(71) Applicant: Kohler Co., Kohler, WI (US)

(72) Inventor: Shashank Varma, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 8 days.

(21) Appl. No.: 15/178,042

(22) Filed: Jun. 9, 2016

(65) Prior Publication Data

US 2017/0356168 A1 Dec. 14, 2017

(51) Int. Cl.
*E03C 1/04* (2006.01)
*B22D 25/02* (2006.01)

(52) U.S. Cl.
CPC ..... *E03C 1/0404* (2013.01); *B22D 25/02* (2013.01); *E03C 1/0403* (2013.01)

(58) Field of Classification Search
CPC ..... E03C 2201/30; E03C 1/0404; E03C 1/042
See application file for complete search history.

(56) References Cited

U.S. PATENT DOCUMENTS 2,627,872 A * 2/1953 Gruen ..... F16K 19/00 137/556.6
3,419,914 A 1/1969 Moen
3,473,558 A 10/1969 Mongerson
3,880,183 A 4/1975 Humpert et al.
3,906,990 A * 9/1975 Nelson ..... E03C 1/042 137/359
3,913,605 A 10/1975 Ward
4,116,210 A 9/1978 Nelson
4,171,005 A 10/1979 Nicklas
5,279,005 A 1/1994 Valley
6,175,972 B1 1/2001 Wales
6,301,727 B1 * 10/2001 Bertrand ..... E03C 1/042 137/359
6,334,463 B1 * 1/2002 Lee ..... E03C 1/0404 137/360
6,378,912 B1 * 4/2002 Condon ..... F16L 5/06 239/273
6,449,784 B1 9/2002 Pelletz
8,424,559 B2 * 4/2013 Huang ..... F16K 1/12 137/359
2012/0266993 A1 * 10/2012 Huang ..... E03C 1/0403 137/874

* cited by examiner

*Primary Examiner* — Janie M Loeppke
(74) *Attorney, Agent, or Firm* — Foley & Lardner LLP

(57) ABSTRACT

A spout for a tub. The spout includes a spout shell having opposite first and second sides. The spout further includes an inlet portion extending from the first side. The spout further includes an outlet portion extending from the second side. The outlet portion includes an outlet bore that is in fluid communication with the inlet portion. The spout further includes a plastic engine configured with waterway connection geometry and one or more locking lips, where the plastic engine is installed in the spout shell through the annular inlet portion and is secured in place by the one or more locking lips prior to reaching the annular outlet portion.

15 Claims, 5 Drawing Sheets

TUB SPOUT ENGINE

BACKGROUND

The present disclosure relates generally to the field of plumbing fixtures (e.g., showers, bathtubs, etc.). More specifically, the present disclosure relates to engines to be installed in spouts of the plumbing fixtures.

SUMMARY OF THE INVENTION

One embodiment relates to a spout for a tub. The spout includes a spout shell having opposite first and second sides; an inlet portion extending from the first side; an outlet portion extending from the second side, wherein the outlet portion includes an outlet bore that is in fluid communication with the inlet portion; and a plastic engine configured with waterway connection geometry and one or more locking lips, where the plastic engine is installed in the spout shell through the annular inlet portion and is secured in place by the one or more locking lips prior to reaching the annular outlet portion. In some embodiments, the spout further comprises a diverter.

Another embodiment relates to an engine for a plumbing fixture. The engine includes an inlet, wherein the inlet is configured as waterway connection geometry; an outlet, wherein the outlet is in fluid communication with the inlet; a locking mechanism, wherein the locking mechanism comprises one or more locking lips configured to secure the engine in an interior of the plumbing fixture; and the engine is plastic.

Yet another embodiment relates to a method of manufacturing a tub spout. The method includes casting a tub spout shell; molding a plastic engine; and installing the plastic engine into the tub spout shell.

Yet another embodiment relates to a spout for a tub. The spout includes a spout shell having opposite first and second sides; an inlet portion extending from the first side; an outlet portion extending from the second side, wherein the outlet portion includes an outlet bore that is in fluid communication with the inlet portion; an engine configured with waterway connection geometry and comprising a trough and a mating hole; and a diverter structured to partially reside in the trough and move between an open position and a closed position. In some embodiments, the diverter comprises a post for coupling with the mating hole, creating an axis of rotation for the diverter. In some embodiments, the diverter comprises a depression that prevents the diverter from moving between the closed position and the open position when water is flowing through the engine. In some embodiments, the diverter comprises a knob that when moved in a first direction rotates the diverter in a first direction to an open position and when moved in a second direction rotates the diverter in a second direction to a closed position.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects if the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only ad should not be regarded as limiting.

Generally speaking, conventional tub spout and engines are made of metal. This requires a supplier to machine several parts of the tub spout before the tub spout is finished. The spout may need to be drilled, milled, tapped, chamfered, and/or deburred since not all of the features of the tub spout could be casted. Therefore, post-casting processing is necessary. This process can be labor intensive, time consuming and expensive.

Accordingly, referring generally to the figures, discloses herein are engines for installing in plumbing fixtures (e.g., tub spouts, showers, etc.) that minimize post-casting machine processing.

Figure 1:
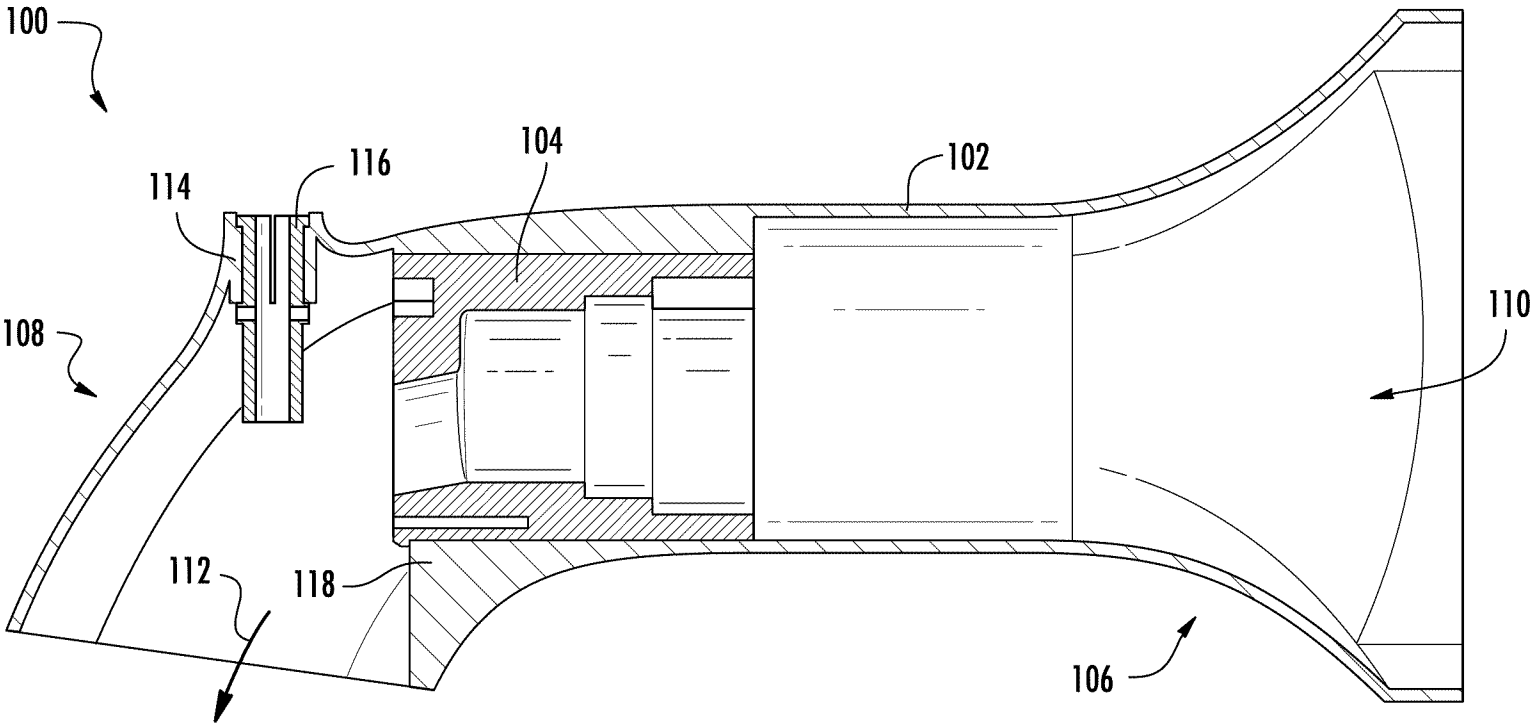
FIG. 1 is a cross sectional view of a tub spout assembly, according to an exemplary embodiment.
Figure 2A:
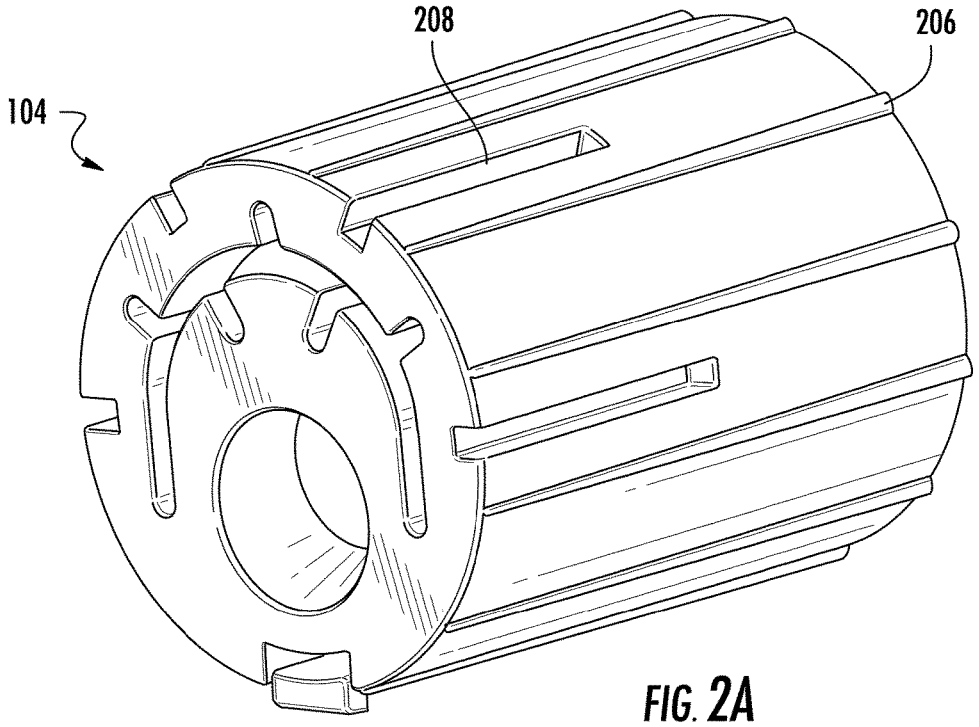
FIG. 2A is a perspective view of an engine, according to an exemplary embodiment.
Figure 2B:
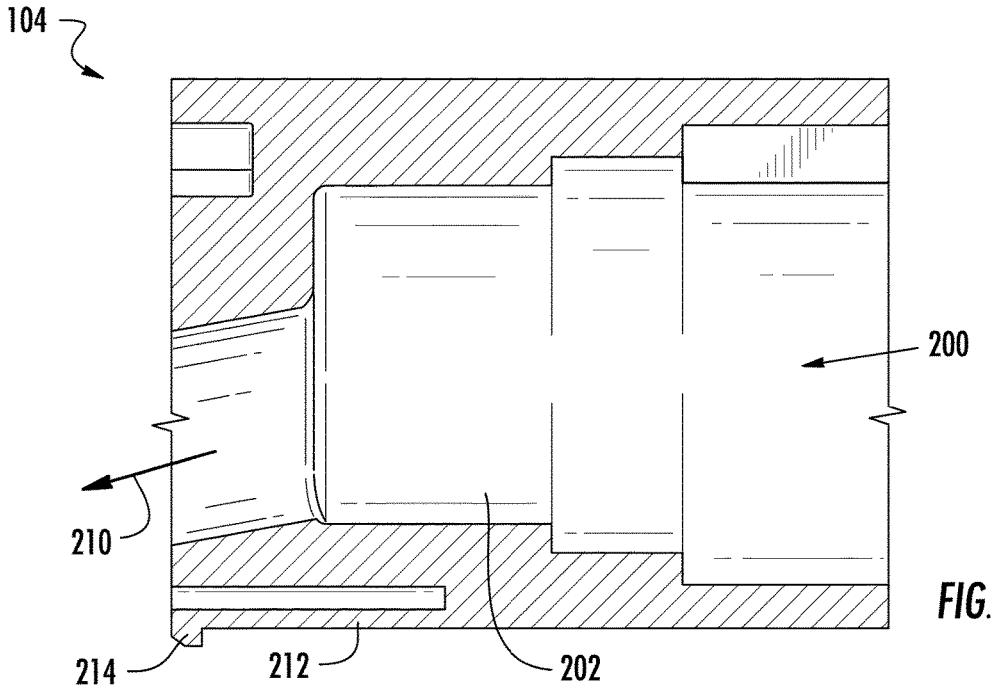
FIG. 2B is a cross section view of the engine of FIG. 2A.

According to an exemplary embodiment shown in FIG. 1, a tub spout assembly 100 includes a spout shell 102 and an engine 104. The spout shell 102 is configured to receive the engine 104. Engine 104 will be described in more detail with respect to FIGS. 2A-3B. The spout shell 102 may be made of metal (e.g., zinc alloy, etc.). The spout shell 102 includes a first side 106 and a second side 108. The first side 106 may be configured to lie flush against a wall when the tub spout assembly 100 is installed. In another embodiment, the first side 106 may be configured such that only a portion of the first side 106 lies flush against the wall when the tub spout assembly 100 is installed. The second side 108 may be configured such that it does not share a longitudinal axis with the first side 106. For example, the second side 108 and the first side 106 may be perpendicular to one another. As another example, the second side 108 and the first side 106 may have longitudinal axes that create an angle greater than 90 degrees. In another embodiment, the first side 106 and the second side 108 may be configured such that the first side 106 and the second side 108 share a longitudinal axis. The first side 106 may have a conical shape. In another embodiment, the first side 106 may rectangular. The second side 108 may be annular. In another embodiment, the second side 108 may be rectangular. However, the first side 106 and the second side 108 may take other forms as well. In some embodiments, the first side 106 includes a securing mechanism. The securing mechanism secures the spout shell 102 to a wall on which the spout assembly 100 is installed. The securing mechanism may be screws, a mechanism that extends the length of the spout shell 102 such that tension is created between the water pipe when connected and the wall, or other means of securing the spout shell 102 to the wall.

The spout shell 102 may also include an inlet portion 110 extending from the first side 106. The spout shell may also include an outlet portion 112 extending from the second side 108. The inlet portion 110 and the outlet portion 112 are in fluid communication with one another. In some embodiments, the inlet portion 110, the outlet portion 112, or both the inlet portion 110 and the outlet portion 112 are annular. In another embodiment, the inlet portion 110, the outlet portion 112, or both the inlet portion 110 and the outlet portion 112 are rectangular or of a different shape. The inlet portion 110 and the outlet portion 112 may be shaped the same, or may have different shapes. In some embodiments, the inlet portion 110 may have a shape that matches the first side 106. In another embodiment, the inlet portion 110 may have a shape that is different than the first side 106. In some embodiments, the outlet portion 112 may have a shape that matches the second side 108. In another embodiment, the outlet portion 112 may have a shape that is different than the second side 108.

The inlet portion 112 is shown to define a flange 118. The flange 118 may be a single flange on a top or bottom of the inlet portion 112. In another embodiment, the flange 118 may be annular and extend along a circumference of the inlet portion 112. In another embodiment, the flange 118 is shaped to match a shape of an interior cavity formed by the inlet portion 110. The flange 118 secures the engine 104 inside the spout shell 102 once the engine 104 is installed. In another embodiment, other methods of securing the engine 104 into the spout shell 102 may be implemented (e.g., threading).

In some embodiments, the tub spout assembly 100 includes a lift rod hole 114. The lift rod hole 114 may be located on the second side 108. The lift rod hole 114 may extend into the outlet portion 112. The lift rod hole 114 defines an opening configured to secure a shroud 116. In some embodiments, shroud 116 is plastic. Shroud 116 may be configured to prevent water from exiting out the lift rod hole 114. The shroud 116 may also be configured to secure a lift rod.

In some embodiments, the spout assembly 100 includes sealing components. The sealing components are intended to provide a seal between the engine 104 and a water pipe. In another embodiment, the sealing components provide a seal between the engine 104 and the spout shell 102. In some embodiments, the sealing components are installed in the engine 104 before the engine 104 is installed in the spout shell 102. In another embodiment, the sealing components are installed in the spout shell 102 before the engine 104 is installed in the spout shell 102.

Figure 3A:
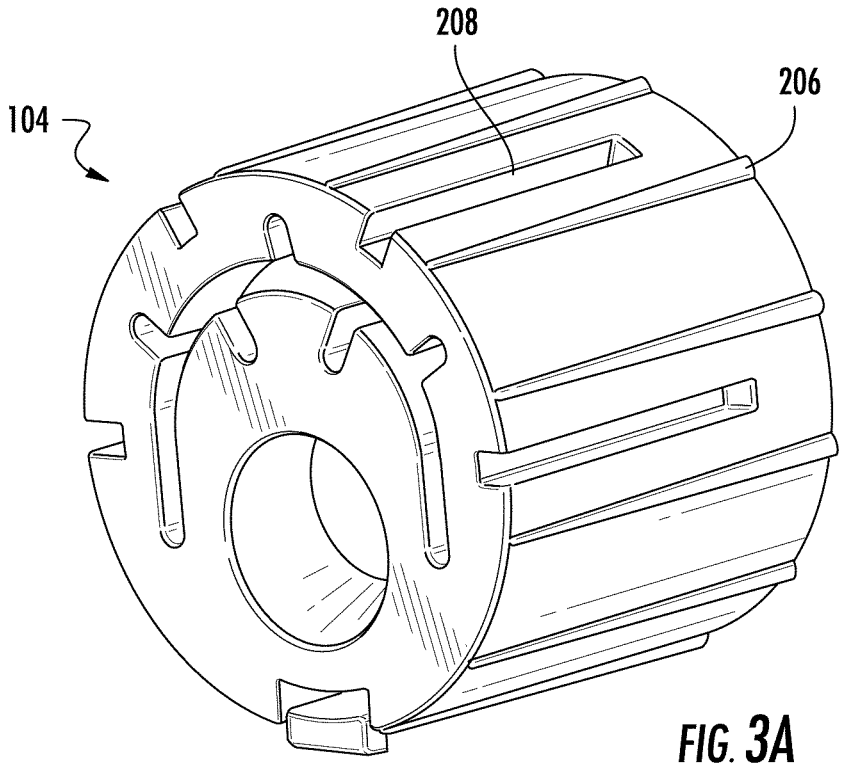
FIG. 3A is a perspective view of an engine, according to another exemplary embodiment.
Figure 3B:
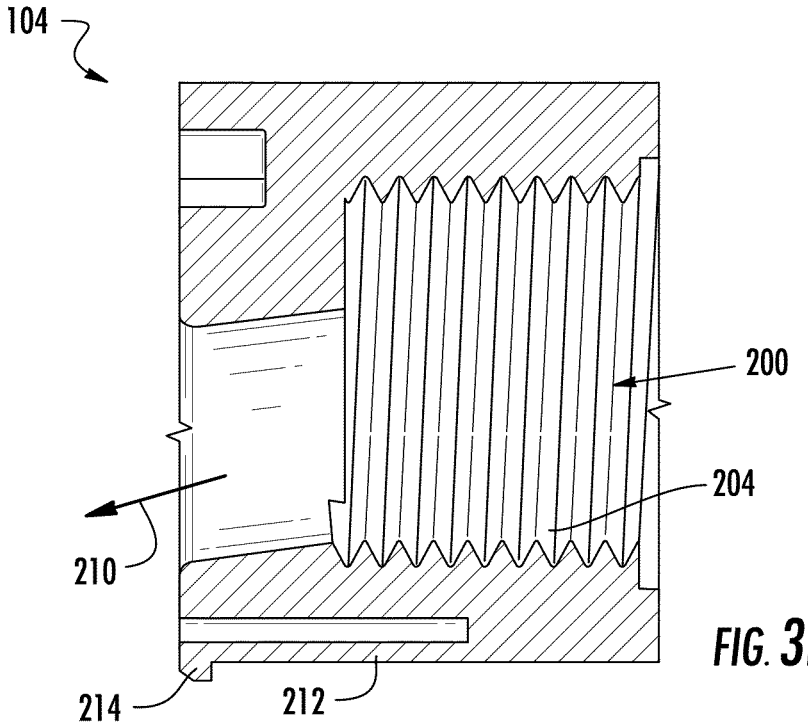
FIG. 3B is a cross sectional view of the engine of FIG. 3A.

Referring now to FIGS. 2A-3B, the engine 104 is shown. The engine 104 is intended to provide connection between the spout shell 102 and a water pipe. The engine 104 may also be intended to direct the flow of water or provide sealing components between the spout shell 102 and the water pipe. The engine 104 includes an inlet 200. The inlet 200 is configured with waterway connection geometry. The waterway connection geometry may include a slip-fit connection 202, as shown in FIG. 2B. In another embodiment, the waterway connection geometry may include national pipe threading (NPT) 204, as shown in FIG. 3B. The exterior of the engine 104 should be configured to fit snugly inside the inlet portion 106 of the tub spout assembly 100. The exterior of the engine 104 may include ridges 206 and/or grooves 208. The ridges 206 and/or grooves 208 may be configured to aid in securing the engine 104 in the spout shell 102 by altering the geometry of the exterior of the engine 104. In some embodiments, the ridges 206 and/or grooves 208 are sealing receivers and may be configured to allow sealing components to be installed in the engine 104. The body of engine 104 may be cylindrical. In another embodiment, the body of engine 104 may be tapered from the inlet 200. The engine 104 also includes an outlet 210. The outlet 210 is in fluid communication with the inlet 200. The outlet 210 provides water to the outlet portion 112 of the spout shell 102. The outlet 210 may be structured to direct water in a specified direction.

The engine 104 includes a locking mechanism that secures the engine 104 into the spout shell 102. The locking mechanism may include one or more locking lips 212. The locking lips 212 may be structured such that when the engine 104 is being inserted into the spout shell 102, the locking lips 212 compress. When the locking lips 212 reach flange 118, a free end 214 extends past the flange 118 and expands, locking the engine 104 into place. In another embodiment, the locking mechanism may be threads. In this embodiment, the spout shell 102 would also include threads.

The engine 104 may be installed in the spout shell 102 at a location such that when the pipe is connected to the waterway connection geometry, the first side 106 of the spout shell 102 abuts a wall on which the spout assembly 100 is being installed.

Figure 4:
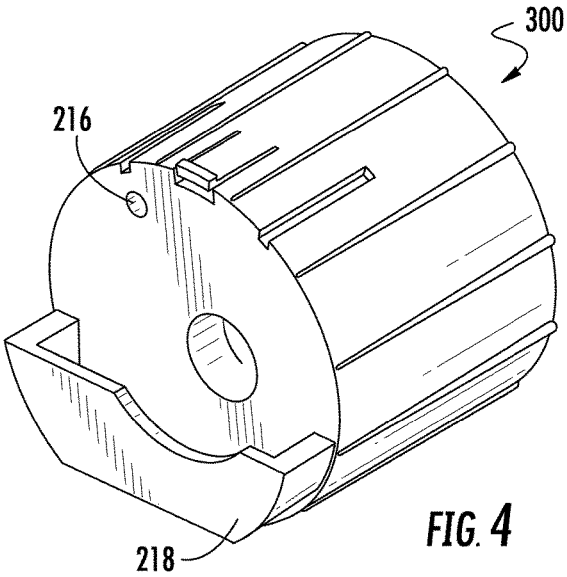
FIG. 4 is a perspective view of another embodiment of an engine, according to an exemplary embodiment.

Referring now to FIG. 4, another embodiment of engine 300 is shown, according to an exemplary embodiment. Engine 300 may be substantially similar to engine 104 described above with respect to FIGS. 2A-3B. However, engine 300 also includes a mating hole 216 and a trough 218. Mating hold 216 allows engine 300 to couple a diverter 220, and allows for rotation of the diverter 220. Mating hole 216 may be location on an upper portion of an output side of the engine 300. Trough 218 may be located on a lower portion of the output side of the engine 300. Trough 218 includes a front, two sides and a bottom and is structured to allow diverter 220 to rotate within the trough. The trough 218 may be shaped such that the sides and bottom follow the shape of the engine 300. In another embodiment, the sides and bottom of the trough 218 are within the circumference of the engine 300. The bottom of trough 218 may be rounded or flat. In some embodiments, the sides of the trough 218 are rounded. In another embodiment, the sides of the trough are flat. The front of the trough 218 may be uniform across a width of the trough. In another embodiment, as shown in FIG. 4, the front of the trough 218 includes a cut out portion. The cut out portion may be semi-circular, rounded, oblong, rectangular, etc. The cut out portion may help minimize the amount of water that is collected in the trough 218 when water is exiting the engine 300. Accordingly, the cut out portion of the trough 218 may align with the outlet of the engine 300. The mating hole 216 and trough 218 should be positioned such that diverter 220 couples with the matting hole 216 and rests in the trough 218, while still allowing diverter 220 to rotate.

Figure 5:
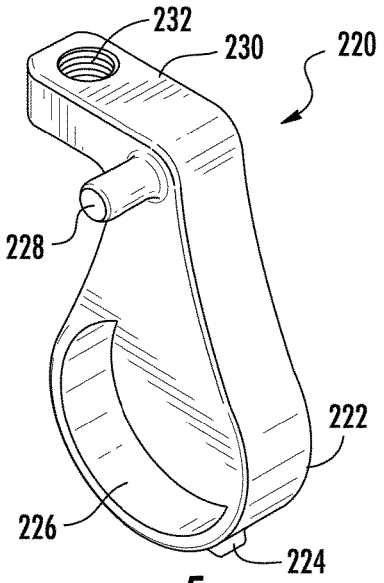
FIG. 5 is a perspective view of a diverter for use with the engine of FIG. 4, according to an exemplary embodiment.

Now referring to FIG. 5, a perspective view of a diverter 220 for use with the engine of FIG. 4, according to an exemplary embodiment. Diverter 220 may be made of the same material as the spout shell 102 or the engine 300. In another embodiment, the diverter 220 is made of a material different that then spout shell 102 or the engine 300. In some embodiments, different components of the diverter 220 are made of different materials (e.g., a combination of metals, a combination of plastics, a combination of metals and plastics, etc.). Diverter 220 may include a base 222 and a knob member 230. The base 222 may be substantially shaped like a raindrop. In another embodiment, the base 222 may be round. In some embodiments, the base 222 may be rectangular with rounded corners. The base 222 of diverter 220 may take various shapes. The base 222 allows water to exit the engine 300 or prevent water from exiting the engine 300 (i.e. to divert the water out a different spout, e.g., a shower head). The base 222 may also include a foot 224 located on a bottom portion of the base 222. The foot 224 may hold the diverter 220 in place, allowing water to exit the engine 300, until diverter 220 is rotated to prevent water from exiting the engine 300. In another embodiment, the foot 224 may hold the diverter 220 in place, preventing water from exiting the engine 300. In yet another embodiment, the foot 224 may aid in holding the diverter 220 in both the open and closed positions. The base 222 may include a single foot 224, or multiple feet. In some embodiments, the feet are on the same side. In another embodiment, the feet are on opposite sides.

The base 222 also includes a depression 226 that extends partially through the base 222 of diverter 22. Depression 226 is located on a side of the base 222 that faces the engine 300. When the diverter 220 is rotated to divert water from the spout assembly 100 to a different spout (e.g., a shower head), the depression 226 fills with water and experiences the pressure of the water, holding the diverter 220 in place until (1) a user moves the diverter 220 away from the engine 300 outlet or (2) the water is turned off. When the user moves the diverter 220, the rotation of the diverter 220 allows water to flow out the outlet of the engine 300. When the water is turned off, the water pressure is no longer exerted on the depression 226, and the diverter 220 may move back to the open position where water can exit the engine 300. In another embodiment, the water that filled the depression 226 maintains the diverter in the closed position where water cannot exit the engine 300. In this embodiment, the user would have to move the diverter 220 in order to allow water to flow out of the engine 300. The depression 226 is shown as being a crescent shape. In another embodiment, the depression 226 may be circular, rectangular, oval, oblong, square, triangular, etc. The depression 226 may fully or partially align with the outlet of the engine 300 when in the closed position. The depression 226 may be placed on the base 222 such that a top, center, side, or bottom of the depression 226 aligns with the outlet of the engine 300, depending on the embodiment.

The knob member 230 is shown to be positioned at the top of base 222. In some embodiments, the knob member 230 may be positioned on a side of the base 222 or a bottom of the base 222. The knob member 230 provides connection between a knob 234 and the base 222. The knob member 230 may be positioned to allow axial movement of the knob 234 to cause rotational movement of the base 222. The rotation of the base 222 is centered around post 228, which is inserted into mating hole 216 of the engine 300 coupling the diverter 220 to the engine 300. Post 228 should fit snuggly into mating hole 216 such that the post 228 is secured within mating hole 216, but can still rotate within mating hole 216. Post 228 is shown to be located where knob member 230 and base 222 meet. However, the post 228 may be located in another location as long as the diverter 220 is able to rotate about the post 228 when axial force is applied to the knob 234.

Knob 234 is coupled to knob member 230. The knob member 230 may include a knob hole 232 with threading and knob 234 may include threading on one end to couple knob 234 with knob hole 232. Knob 234 may be perpendicular to knob member 230. In some embodiments, knob 234 is linear with respect to the knob threading. In another embodiment, knob 234 is angled or curved with respect to the knob threading. Knob 234 may be a cylinder, a rectangular prism, or take the form of another shape. In some embodiments, knob 234 may be textured to provide additional traction for the user. In another embodiment, knob 234 may include grooves or divots to provides a more comfortable fit for the user when moving the knob 234.

Figure 6A:
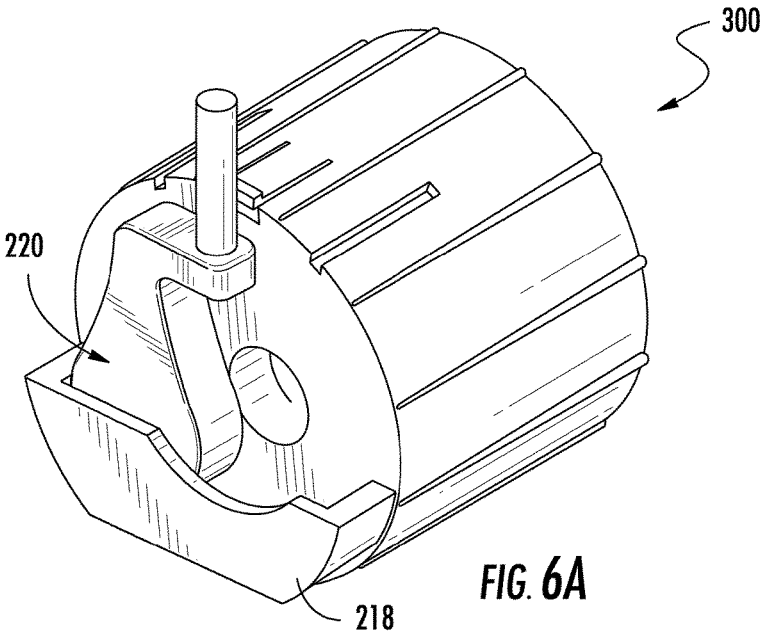
FIG. 6A is a perspective view of the diverter of FIG. 5 coupled to the engine of FIG. 4, according to an exemplary embodiment.
Figure 6B:
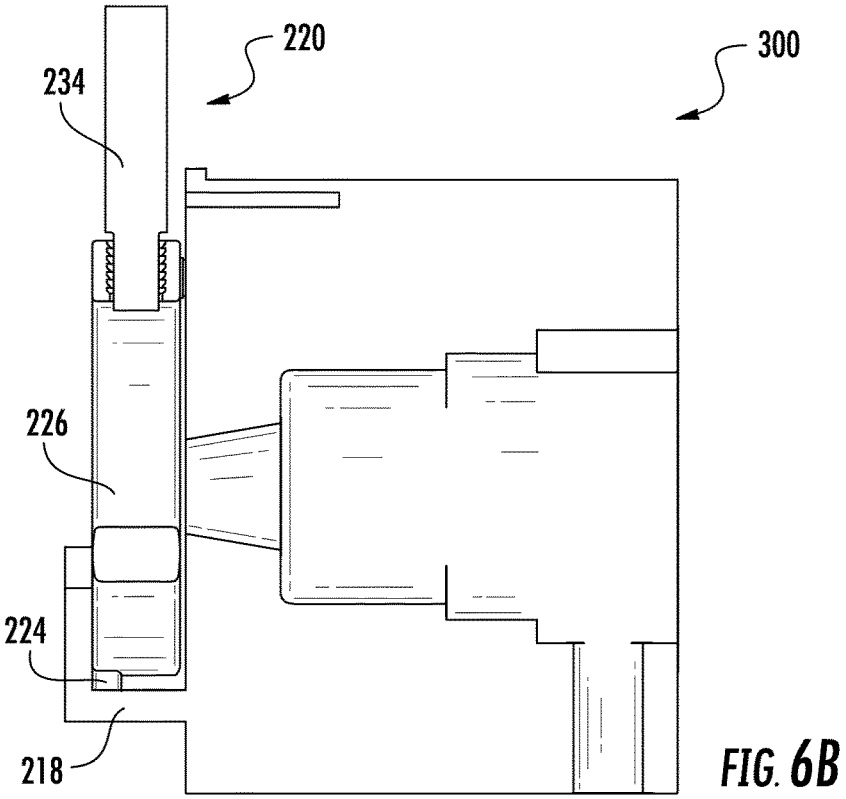
FIG. 6B is a cross sectional view of the diverter of FIG. 5 coupled to the engine of FIG. 4, according to an exemplary embodiment.
Figure 6C:
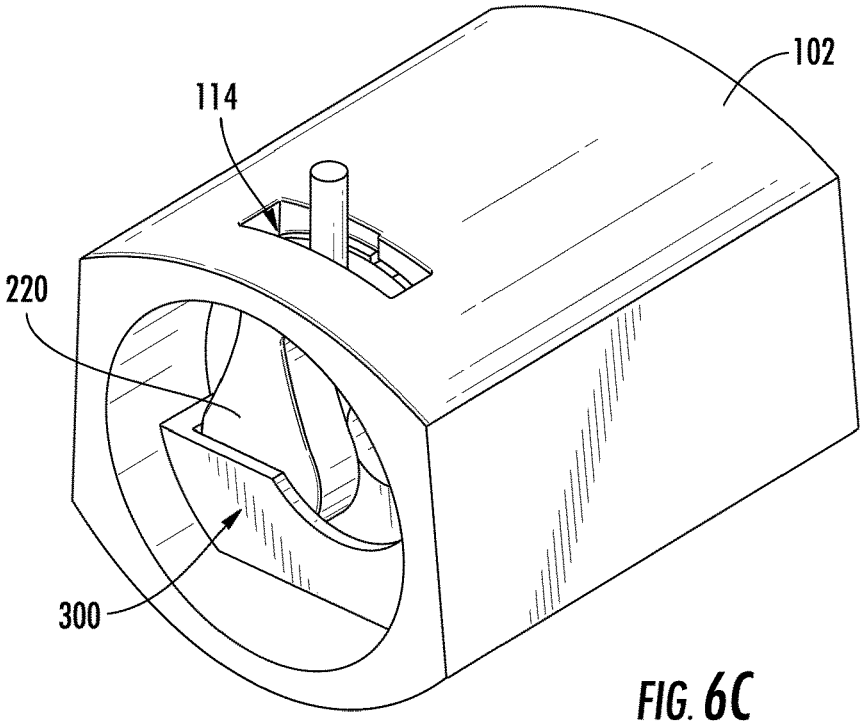
FIG. 6C is a perspective view of diverter of FIG. 5 coupled to the engine of FIG. 4 and installed in a spout shell, according to an exemplary embodiment.

Referring now to FIGS. 6A-6C, various views of diverter 220 coupled to the engine 300 are shown, according to an exemplary embodiment. When coupled together, the engine 300 and the diverter 220 may be flush with one another. In another embodiment, the diverter 220 and or the engine 300 are structured such that there is a gap between the end of the engine 300 and a face of the diverter 220. Specifically, FIG. 6C shows the engine 300 and the diverter 220 installed in the spout shell 102. When diverter 220 is used knob 234 extends through lift rod hole 114. In some embodiments, lift rod hole 114 may be rectangular to allow bidirectional movement of the knob 234 along a surface of the spout shell 102. The lift rod hole 114 may be completely open. In another embodiment, the lift rod hole 114 may be filled with a deformable material that allows the knob 234 to move, but minimizes the amount of water or other substances (e.g., dust, soap, etc.) that may enter the spout shell 102 through the lift rod hole 114.

In some embodiments, the engines 104 and 300 are made of plastic. The engines 104 and 300 may made using a mold. With the engine 104 being made of plastic, less zinc is used in the spout assembly 100. In addition, less machining is required one the spout assembly 100 resulting in less time to be spent on each cast part to bring the spout assembly 100 to a finished stage. Therefore, the parts are "touched" less during the manufacturing process, which drives down scrap rates. Overall, the engines 104 and 300 may save time and money by reducing labor costs, material costs and reducing the complexity required to make the parts as plastic is easier to mold than metal (e.g., zinc alloy). In addition, by making the engines 104 and 300 out of plastic, less time is needed for the spout assembly to be cast because less zinc is used so the spout assembly 100, and more specifically, spout shell 102, cools more quickly. Little to no machining may need to be completed post-casting.

Once the spout shell 102 is cast, the engines 104 and 300 may be installed into the spout shell 102 by pushing the engine 104 into the spout shell 102 via the inlet portion 110 until the engines 104 or 300 is locked into place. By creating a plastic engine that can be installed in a spout shell, the plastic engine may be shared across several spout shell designs. Therefore, a new engine does not have to be engineered for every spout shell. Instead spout shells can be designed around the engine, allowing variability in the aesthetics of the spout shells, while keeping the engine consistent. This allows consistency across products in both cost and quality, while still allowing design freedom with respect to the aesthetics of the spout shell.

According to any embodiment, a spout for a tub is shown to include a spout shell, a plastic engine, a diverter and sealing components. The spout shell is shown to include a first portion, a second portion, an inlet, an outlet, a lift rod hole, a shroud, and a flange. The engine is shown to include an inlet, waterway connection geometry, a ridge, a groove, an outlet, and a locking lip with a free end. However, other embodiments may include or omit certain components to suit particular applications.

As utilized herein, the terms "approximately," "about," "around," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the spout assemblie as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Features of any of the embodiments may be employed separately or in combination with any other feature(s) of the same or different embodiments and the disclosure extends to and includes all such arrangements whether or not described herein.

Other substitutions, modifications, changes and omissions may also be made in the design, operating conditions and arrangement of the various exemplary embodiments without departing from the scope of the inventions described herein.

What is claimed is:

1. A spout for a tub, the spout comprising:

a spout shell having opposite first and second sides;

an annular inlet portion extending from the first side;

an annular outlet portion extending from the second side, wherein the outlet portion includes an outlet bore that is in fluid communication with the inlet portion; and a plastic engine configured with waterway connection geometry and one or more locking lips integrally formed with the plastic engine, where the plastic engine is installed in the spout shell through the annular inlet portion and is secured in place by the one or more locking lips prior to reaching the annular outlet portion, where insertion of the plastic engine within the spout shell is configured to cause compression of at least one of the one or more locking lips through an interaction between the at least one of the one or more locking lips and the spout shell, and where the one or more locking lips are located within the spout shell when the plastic engine is installed in the spout shell.

2. The spout of claim 1, wherein at least one of the spout shell and the plastic engine is configured to receive one or more sealing components.

3. The spout of claim 1, wherein the plastic engine is configured to receive one or more sealing components prior to installation into the spout shell.

4. The spout of claim 1, wherein the waterway connection geometry is a slip-fit connection.

5. The spout of claim 1, wherein the waterway connection geometry is national pipe threading (NPT).

6. The spout of claim 1, wherein the plastic engine has a cylindrical body.

7. The spout of claim 1, wherein the plastic engine has a tapered body.

8. The spout of claim 1, wherein the one or more locking lips surround a circumference of the plastic engine.

9. The spout of claim 1, further comprising a diverter.

10. A spout for a tub, the spout comprising:

a spout shell having opposite first and second sides;

an inlet portion extending from the first side;

an outlet portion extending from the second side, wherein the outlet portion includes an outlet bore that is in fluid communication with the inlet portion;

an engine configured with waterway connection geometry and configured to be installed within the spout shell such that the engine is entirely located within the spout shell when the engine is installed in the spout shell, the engine comprising a trough and a mating hole, where the engine terminates in an outlet end opposite the first side, and where the trough extends from the outlet end; and a diverter structured to partially reside in the trough such that the diverter is maintained proximate the outlet end and moveable between an open position and a closed position.

11. The spout of claim 10, wherein the diverter comprises a post for coupling with the mating hole, creating an axis of rotation for the diverter.

12. The spout of claim 10, wherein the diverter comprises a depression that prevents the diverter from moving between the closed position and the open position when water is flowing through the engine.

13. The spout of claim 10, wherein the diverter comprises a knob that when moved in a first direction rotates the diverter in a first direction to an open position and when moved in a second direction rotates the diverter in a second direction to a closed position.

14. The spout of claim 10, wherein at least one of the engine or the diverter is plastic.

15. The spout of claim 10, wherein a base of the diverter is teardrop shaped.

* * * * *